US010542782B2

(12) United States Patent
Shupe et al.

(10) Patent No.: US 10,542,782 B2
(45) Date of Patent: Jan. 28, 2020

(54) MEN'S BRIEFS

(71) Applicant: Stance, Inc., San Clemente, CA (US)

(72) Inventors: Taylor Shupe, San Clemente, CA (US); Justin Cleveland, Orange, CA (US)

(73) Assignee: Stance, Inc., San Clemente, CA (US)

( * ) Notice: Subject to any disclaimer, the term of this patent is extended or adjusted under 35 U.S.C. 154(b) by 101 days.

(21) Appl. No.: 15/049,940

(22) Filed: Feb. 22, 2016

(65) Prior Publication Data

US 2017/0238619 A1 Aug. 24, 2017

(51) Int. Cl.

| | |
|---|---|
| ***A41B 9/08*** | (2006.01) |
| ***A41B 9/02*** | (2006.01) |
| *A41B 9/04* | (2006.01) |

(52) U.S. Cl.

CPC ..... *A41B 9/023* (2013.01); *A41B 9/04* (2013.01)

(58) Field of Classification Search

CPC ..... A41B 9/023; A41B 9/001; A41B 9/04
USPC ..... 2/403
See application file for complete search history.

(56) References Cited

U.S. PATENT DOCUMENTS 2,669,107 A * 2/1954 Phillips ..... D04B 35/10 66/166
4,377,008 A * 3/1983 Jung ..... A41B 9/023 2/403
4,421,512 A * 12/1983 Papajohn ..... A61F 13/76 604/396
5,029,345 A * 7/1991 Angheluta ..... A41B 9/023 2/403
5,647,065 A * 7/1997 Richerson ..... A41B 9/023 2/227
5,875,495 A * 3/1999 Thrower ..... A41B 9/023 2/236
6,038,703 A * 3/2000 Chung ..... A41B 9/023 2/400
6,901,607 B1 * 6/2005 Elwell ..... A41B 9/023 2/400
7,958,571 B2 6/2011 Kitsch et al.
D656,708 S * 4/2012 Ellis ..... D2/712
8,555,422 B2 * 10/2013 Steele ..... A41B 9/023 2/400
8,595,956 B2 * 12/2013 Byrne ..... A43B 13/122 36/30 R
8,800,064 B2 8/2014 Delija et al.
2005/0268380 A1 * 12/2005 Sovell ..... A41B 9/023 2/400
2006/0162052 A1 * 7/2006 Stankowski ..... A41B 9/02 2/403

(Continued)

*Primary Examiner* — Timothy K Trieu
(74) *Attorney, Agent, or Firm* — Ganz Pollard, LLC

(57) ABSTRACT

A man's briefs have a torso encircling member which consists of a front portion and a rear portion, an elastic waist band portion disposed at the top of the torso encircling member, and a genitalia receiving compartment formed by a midsection of the front portion and a strip of fabric associated with the inside of the front portion. The strip of fabric is coupled to the front portion so that the strip is oriented parallel to the front portion. The strip has two top ends connecting to the waist band portion, and a bottom section extending downwardly to loop around the bottom of scrotum of the wearer. The strip of fabric has a curved narrow opening for receiving the genitalia, and may have no seam binding at the edge of the opening.

19 Claims, 9 Drawing Sheets

(56) References Cited

U.S. PATENT DOCUMENTS

| | | | | |
|---|---|---|---|---|
| 2007/0283484 | A1* | 12/2007 | Wright | A41B 9/02 2/404 |
| 2012/0167279 | A1* | 7/2012 | Bigney | A41B 9/02 2/401 |

* cited by examiner

MEN'S BRIEFS

BACKGROUND

The inventive subject matter is generally directed to a garment for a male that includes a genitalia receiving compartment with an innovative design to provide improved comfort and support for the intended wearer.

Conventional designs of men's garment such as underwear, briefs, boxers, tights, trunks, swimwear, surf wear, etc., typically have a number of limitations. For example, the scrotum may have a tendency to contact and/or stick to the inner surfaces of the upper thighs, thus causing friction and chaffing during movement. In another example, accumulation of sweat or residue of urine may dampen or make sticky the male genitalia and cause discomfort, irritation, and/or hygiene issues to the wearer. While some prior art, e.g., U.S. Pat. No. 8,800,064 B2, U.S. Pat. No. 7,958,571 B2, and U.S. Patent Application Publication No. 2006/0162052 A1, teach several types of male underpants that include a pouch for receiving the male genitalia and separating it from the inner surfaces of the upper thighs, the design of the pouch is generally not optimal. The pouch may be too loose to securely hold the male genitalia, or very restrictive such that the problem of chaffing and/or moisture accumulation still persist. For example, U.S. Patent Publication No. 2006/0162052 A1 discloses a male undergarment with a protective pouch, which includes a two-ply scrotum receiving section and a separate boarder element. The border element, which is primarily made from inelastic material, is attached to a scrotum receiving section at a location that is markedly below the waist band. In addition, the border element is oriented generally perpendicular to the front portion of the undergarment so that it can be longitudinally folded by the pressure exerted by the inner thighs as the garment is worn. This design has at least two shortcomings. First, since the border element protrudes inwardly, its edges, which contact the crotch region of the wearer, can irritate skin and cause discomfort to the wearer, particularly during body movement. Second, because of the vertical orientation of the border element, and how far below the waist band it is, the opening of the pouch is relatively large, whereas the effective volume enclosed by the pouch (i.e., the pouch volume covered by the border element) is small. Hence, if the undergarment is laterally stretched, e.g., due to spreading legs, the left and right edges of the border element may be pulled away from each other, thus further increasing the size of the pouch opening, which may cause the wearer's scrotum to lose support or even fall out of the pouch.

Accordingly, there is a need for an improved underwear for male that provides fuller and more comfortable support and less irritation for the male genitalia, prevents it from contacting the inner surfaces of the upper thighs, and reduces the accumulation of perspiration.

SUMMARY

The inventive subject matter is generally directed to a garment for a man with improved comfort and support. The garment includes a torso encircling member which consists of a front portion and a rear portion, an elastic waist band portion disposed at the top of the torso encircling member, and a genitalia receiving compartment formed by a midsection of the front portion and a strip of fabric associated with the inside of the front portion. The strip of fabric is coupled to the front portion so that the strip is oriented substantially parallel to the front portion. In some embodiments, stitching is used to couple and orient the strip on the front portion.

According to some representative embodiments of the inventive subject matter, the strip of fabric has two top ends connecting to the waist band portion, and a bottom section extending downwardly to loop around the bottom of scrotum of the intended wearer. In some embodiments, the two top ends are separated from one another on the waist band portion so that the strip of fabric forms an elongated U-shape opening for receiving the genitalia. In other embodiments, the two top ends are merged on the waist band portion so that the strip of fabric forms an almond-shaped opening for receiving the genitalia.

According to some embodiments of the inventive subject matter, the strip of fabric has no seam binding at the edge of the opening for receiving the genitalia. The absence of seam binding at the edge of the opening may be achieved by a skipped-needle knitting technique.

In certain embodiments, the width of the opening is sufficiently narrow so as to prevent a genitalia of the wearer from inadvertently escaping the genitalia receiving compartment during normal use. The strip of fabric may be wider in the bottom section than the top ends. In some embodiments, the genitalia receiving compartment has an outwardly bulging space at the bottom section of the strip of fabric. According to certain embodiments, the strip of fabric may be predominantly made of elastic mesh material to improve ventilation. In addition, the front portion and the rear portion may be predominantly made of elastic material so as to be stretchable and form a comfortable fit to the lower torso of the wearer.

These and other embodiments are described in more detail in the following detailed descriptions and the figures. Other embodiments are contemplated in the Detailed Description below and in the appended Figures, and in the claims, as originally written or amended, the claims as such being incorporated by reference into this Summary.

The foregoing is not intended to be an exhaustive list of embodiments and features of the inventive subject matter. Persons skilled in the art are capable of appreciating other embodiments and features from the following detailed description in conjunction with the drawings.

BRIEF DESCRIPTION OF THE DRAWINGS

The appended figures show embodiments according to the inventive subject matter, unless noted as showing prior art.

DETAILED DESCRIPTION

Figure 1:
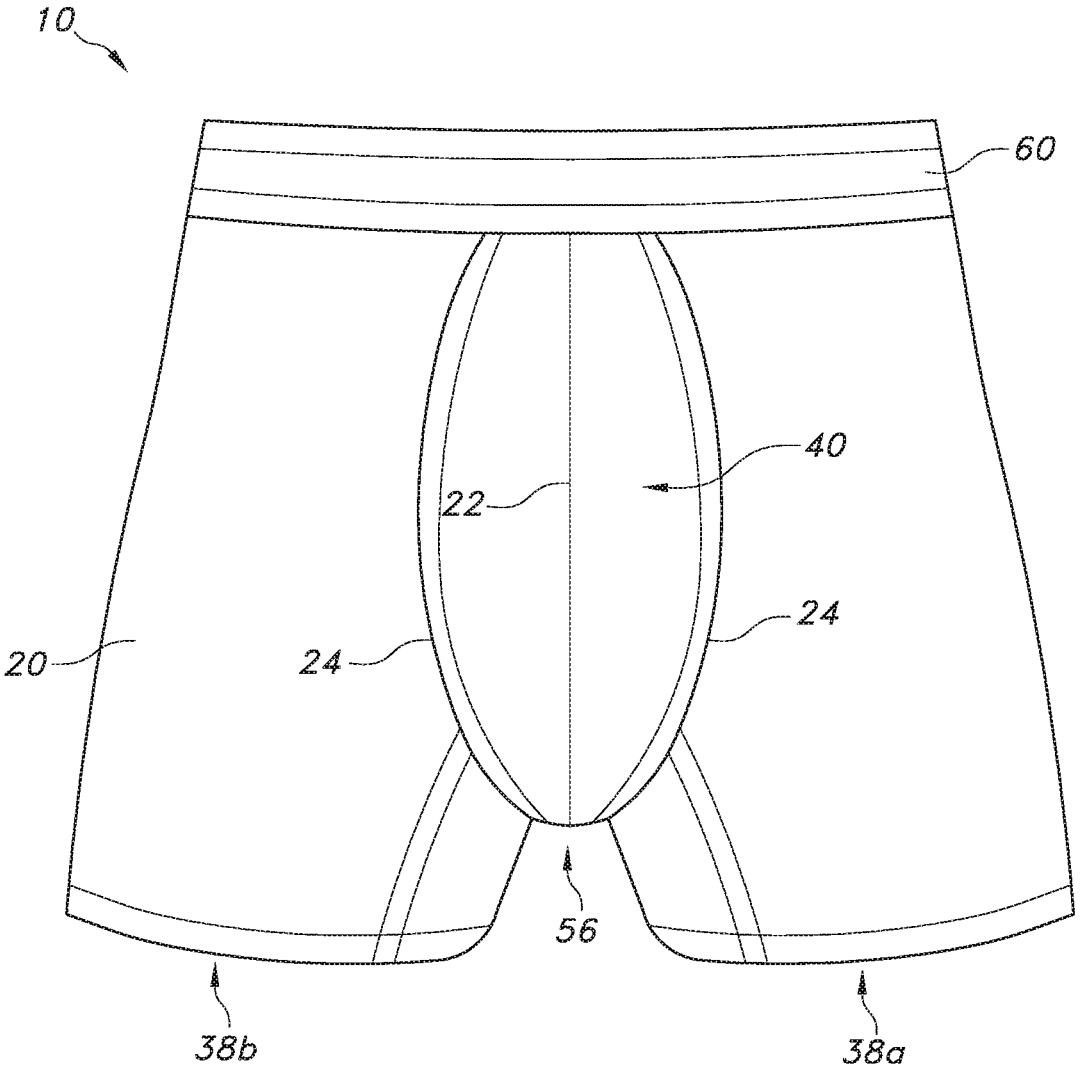
FIG. 1 is a front view of a pair of male underwear according to one embodiment of the inventive subject matter.
Figure 2:
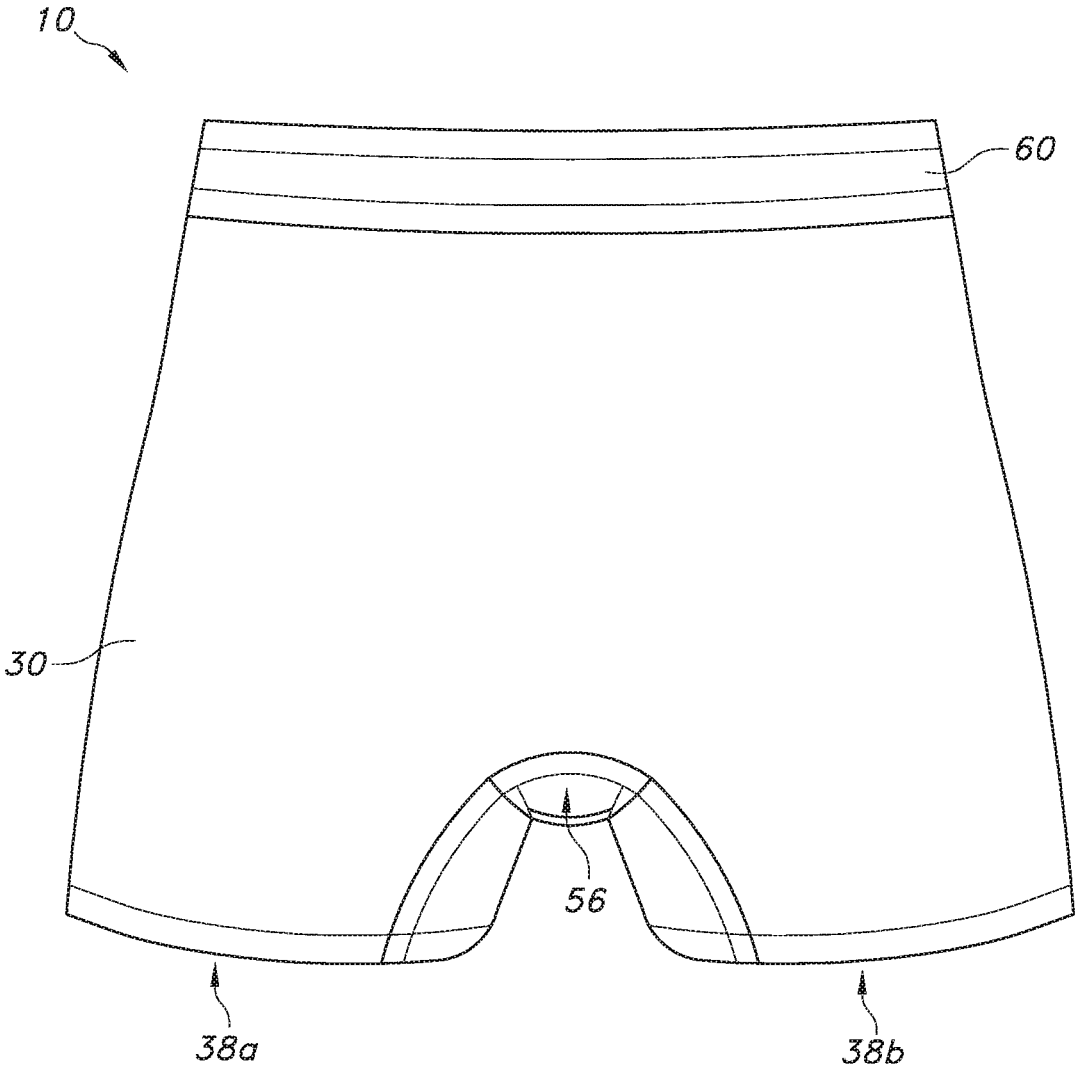
FIG. 2 is a rear view of the underwear of FIG. 1.
Figure 3:
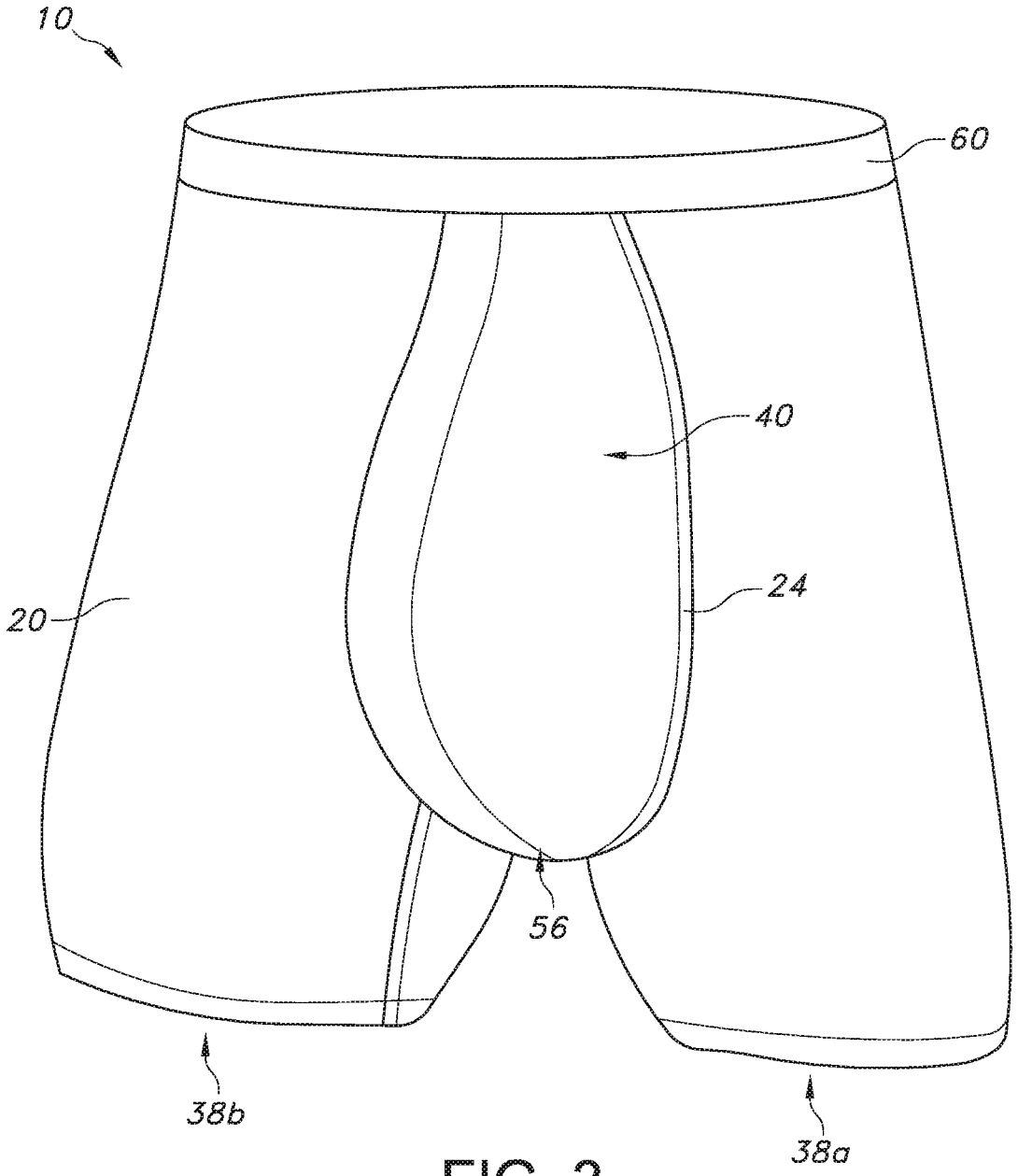
FIG. 3 is a side view of the underwear of FIG. 1.

Representative embodiments according to the inventive subject matter are shown in FIGS. 1-7, wherein the same or generally similar features share common reference numerals.

The inventive subject matter is generally directed to a garment that fits at least around an intended male wear's groin area. The garment includes a torso encircling member which consists of a front portion and a rear portion, an elastic waist band portion disposed at the top of the torso encircling member, and a genitalia receiving compartment formed by a midsection of the front portion and a strip of fabric associated with the inside of the front portion. The strip of fabric is coupled to the front portion so that the strip is oriented substantially parallel to the front portion.

The garment may be a man's brief, boxer, trunk, tights, or swimwear. By way of illustration and without any limitation, an item of underwear will be used hereafter to illustrate principles of the inventive subject matter.

According to one representative embodiment of the inventive subject matter, as shown in FIGS. 1-6, the underwear includes a torso encircling member 10 which consists of a front portion 20 and a rear portion 30, an elastic waist band portion 60 disposed at the top of the torso encircling member, and a genitalia receiving compartment 40. In some embodiments, both the front portion 20 and the rear portion 30 may be predominantly made of elastic material so that the underwear may be stretchable and form a comfortable, snug fit to the lower torso of the wearer.

Figure 7:
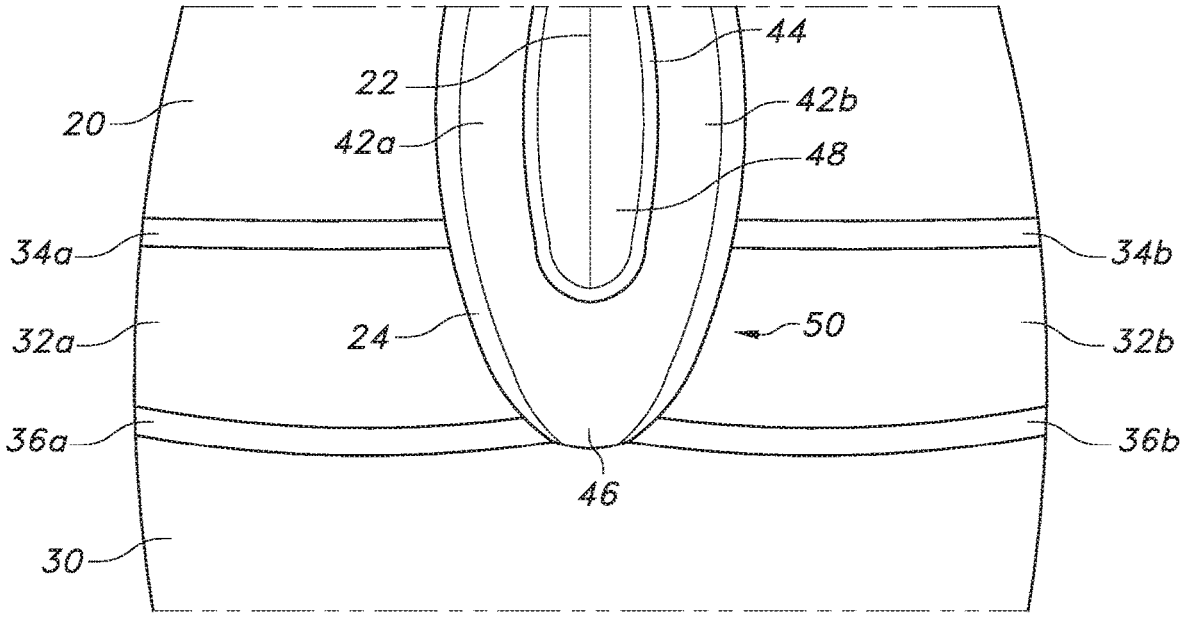
FIG. 7 shows the interior plan view of the crotch area of the underwear of FIG. 4 or FIG. 5.

In certain embodiments, the front portion 20 may join, either by seams or seamlessly, the rear portion 30 in the bottom region of the torso encircling member 10. In other embodiments, as illustrated in FIG. 7, the underwear may further include two separate crotch pieces 32*a*, 32*b*, which provide contact with the crotch area of the intended wearer. The crotch pieces respectively connect the left and right bottom edges of the front portion by seams 34*a*, 34*b* on one side, and connect to the left and right bottom edges of the rear portion by seams 36*a*, 36*b* on the other side. The bottom edges of the body encircling member form two openings 38*a*, 38*b*, for passing left thigh and right thigh of the intended wearer, respectively. The mid-bottom area of the front portion may join directly with the mid-bottom area of the rear portion, near the bottom region 56 of the genitalia receiving compartment 40 and between the two thigh-passing openings 38*a*, 38*b*. The bottom region 56 of the genitalia receiving compartment 40 is generally positioned higher than the lowest edge of the thigh-passing openings 38*a*, 38*b*. However, in other possible embodiments, the thigh openings can be above, at least in part, the bottom region 56.

According to a typical embodiment of the inventive subject matter, the genitalia receiving compartment 40 is formed by a midsection of the front portion 20 and a strip of fabric 50 associated with the inside of the front portion 20. The strip 50 has a generally curved shape, forming a narrow opening 48 to the genitalia receiving compartment 40. The strip of fabric 50 is coupled to the front portion 20 so that the strip 50 is naturally oriented substantially parallel to the front portion 20. In other words, the strip of fabric 50 sits substantially flat on the front portion 20 when the underwear is flat. As used herein, "substantially flat" means when the front portion of the underwear is naturally spread—without wrinkled or tensioned—on a flat surface, the strip of fabric 50 is adapted to be generally coplanar with the front portion 20 of the underwear, i.e. the angle between the plane formed by the strip 50 and the plane formed by the front portion 20 is 45 degree or less. Generally, the entire area of the strip 50 including its peripheral seam 24 and the opening edge 44 contacts the inside surface of the front portion 20.

Figure 8A:
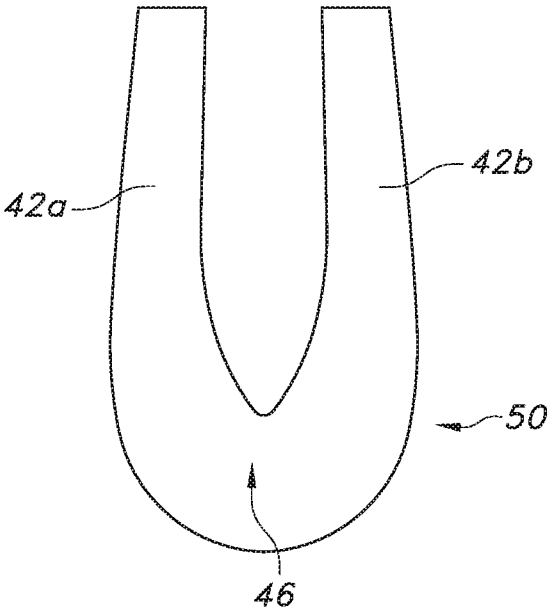
FIG. 8A shows the plan view of a strip of fabric according to an embodiment of the inventive subject matter.
Figure 8B:
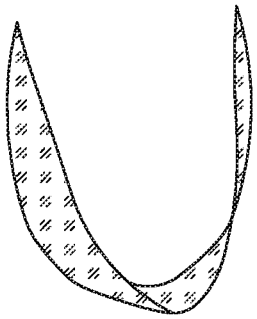
FIG. 8B (PRIOR ART)
FIG. 8B shows the plan view of a border element when it forms part of the scrotum receiving pouch as disclosed in prior art.
Figure 8C:
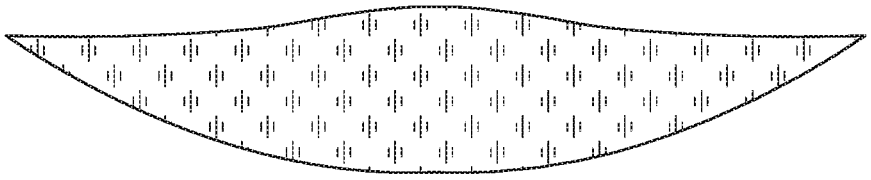
FIG. 8C (PRIOR ART)
FIG. 8C shows the plan view of the border element depicted in FIG. 8B it is spread flat.
Figure 9:
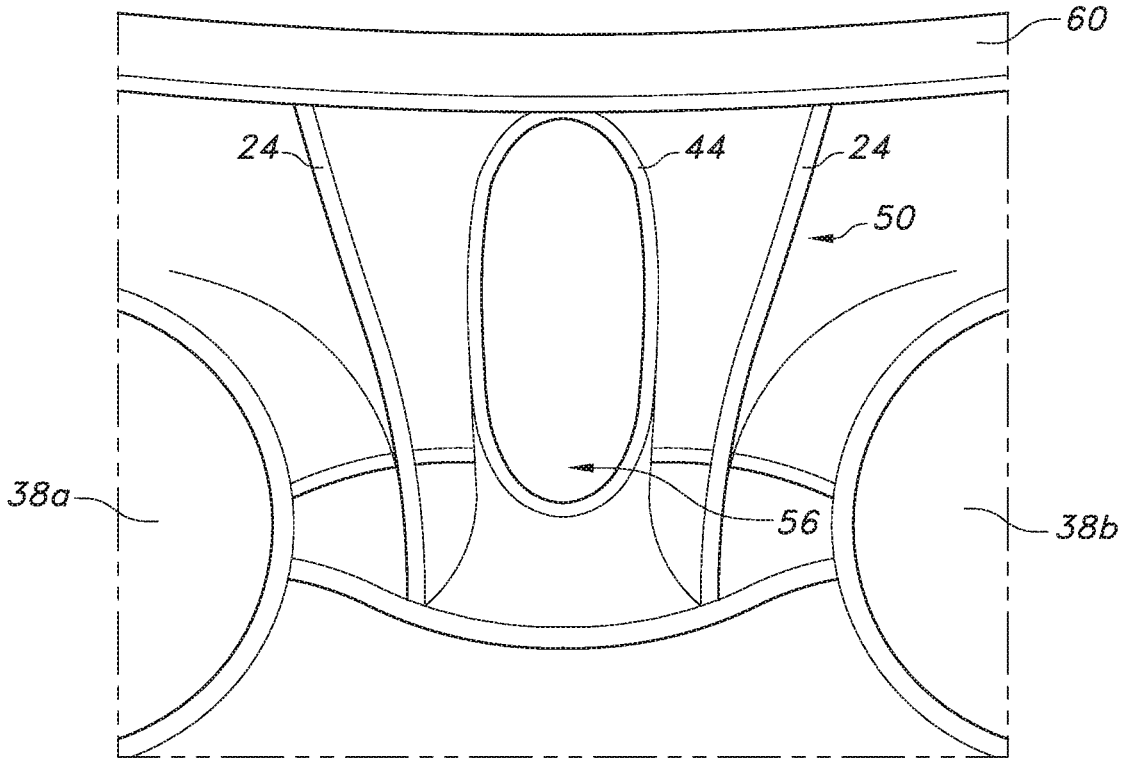
FIG. 9 shows the top view of a male underwear including its genitalia receiving compartment according to an embodiment of the inventive subject matter.

As shown in FIG. 8(*a*), the strip 50 of the inventive subject matter has a general U-shape when spread flat. In contrast, the border element disclosed in U.S. Patent Publication No. 2006/0162052 A1 and depicted in FIG. 8(*b*), is oriented generally perpendicular to the front portion as it forms part of the scrotum receiving pouch. When it is spread flat, the border element forms a horizontal strip with varying width, and it in no way is in the nature of a U-shape.

In some embodiments, stitching is used to couple and orient the strip 50 on the front portion 20. As exemplified in FIGS. 4-5, the strip of fabric 50 is coupled to the front portion 20 by peripheral seam 24 surrounding the genitalia receiving compartment 40, and by stitching lines that connect the top ends 26 *a*, 26 *b* of the strip 50 to the waist band portion 60. According to certain embodiments, the strip of fabric 50 may be predominantly made of elastic mesh material to improve ventilation. In other embodiments, the strip of fabric 50 may be seamlessly woven or knit to the front portion, with the strip thereby being coupled and oriented substantially flat.

Figure 4:
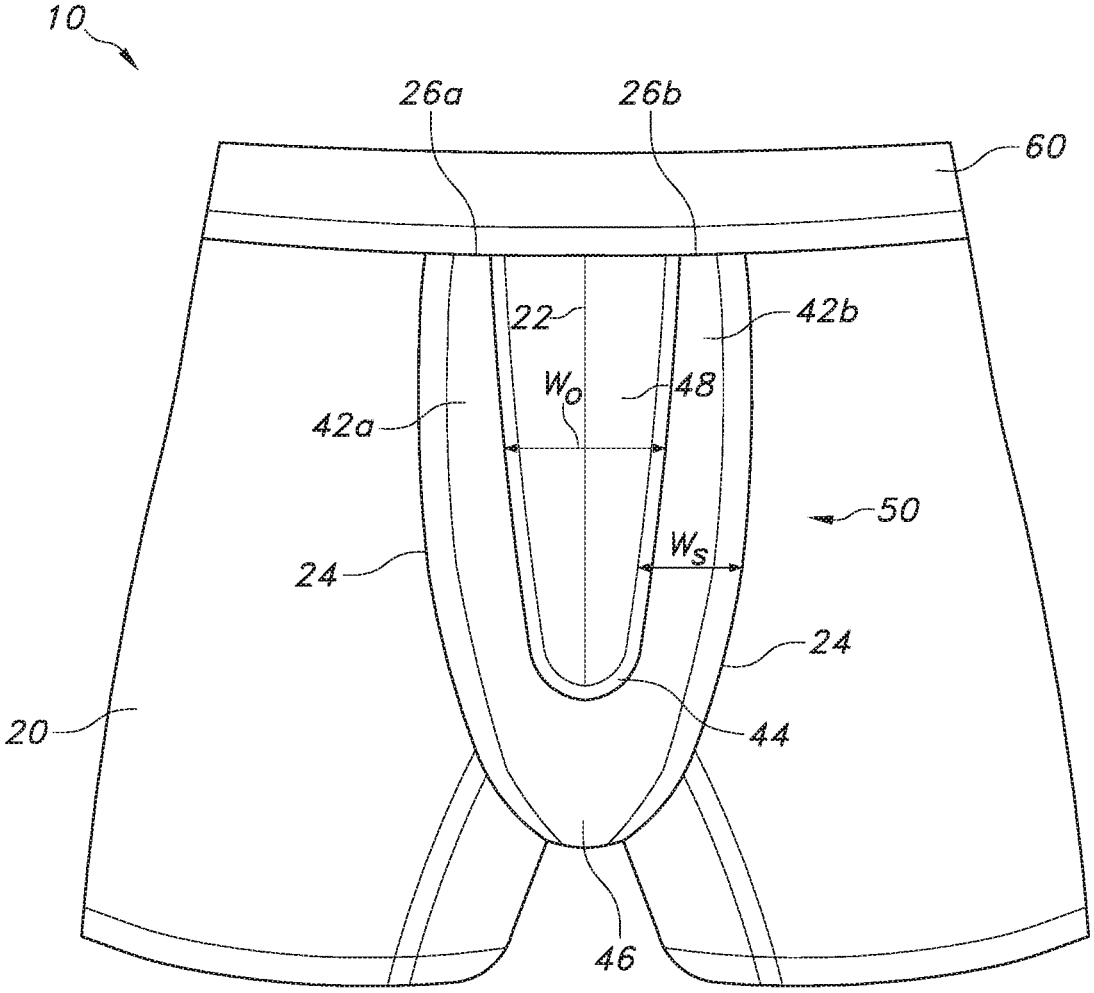
FIG. 4 shows the interior plan view of the genitalia receiving compartment formed by a front portion of the underwear and an associated strip of fabric, according to one embodiment of the inventive subject matter.
Figure 5:
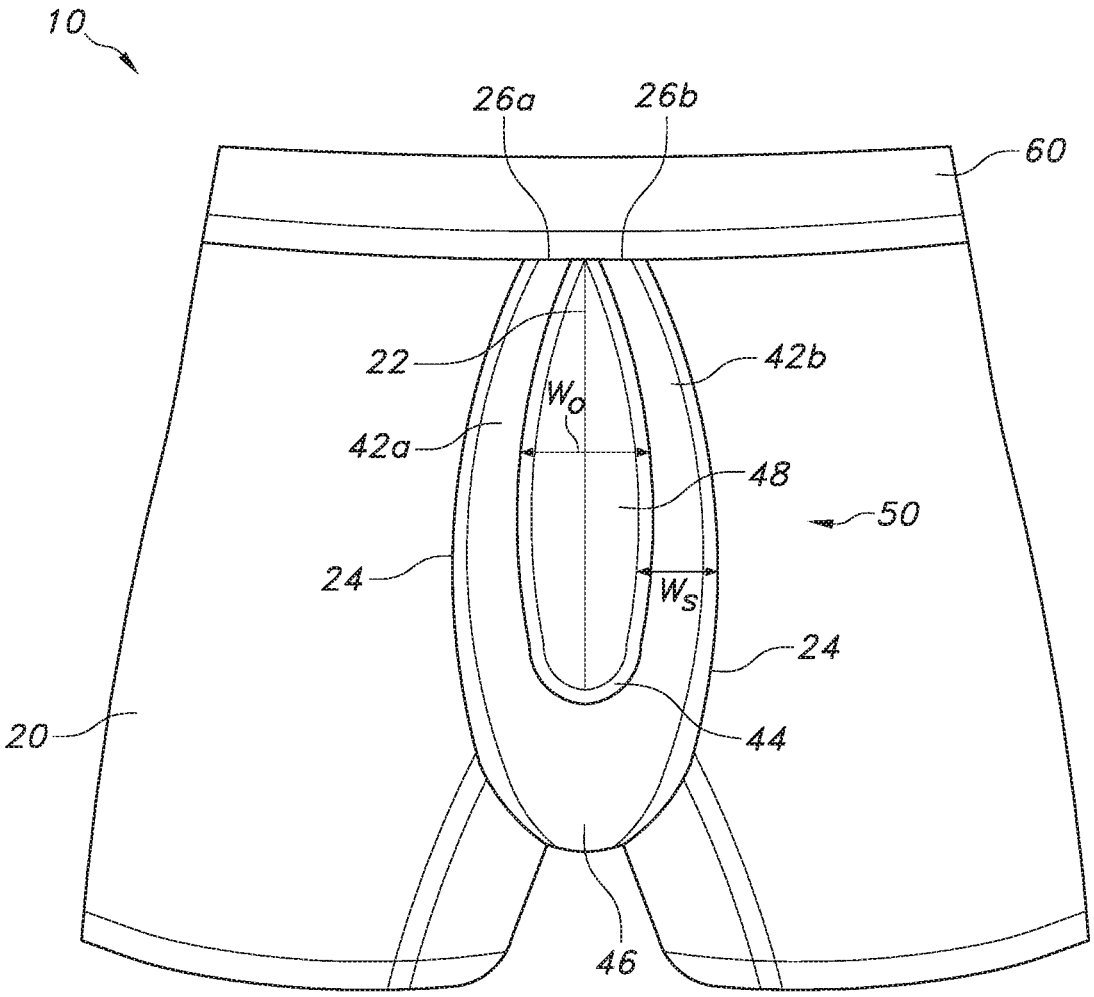
FIG. 5 shows the interior plan view of the genitalia receiving compartment formed by a front portion of the underwear and an associated strip of fabric, according to another embodiment of the inventive subject matter.
Figure 6:
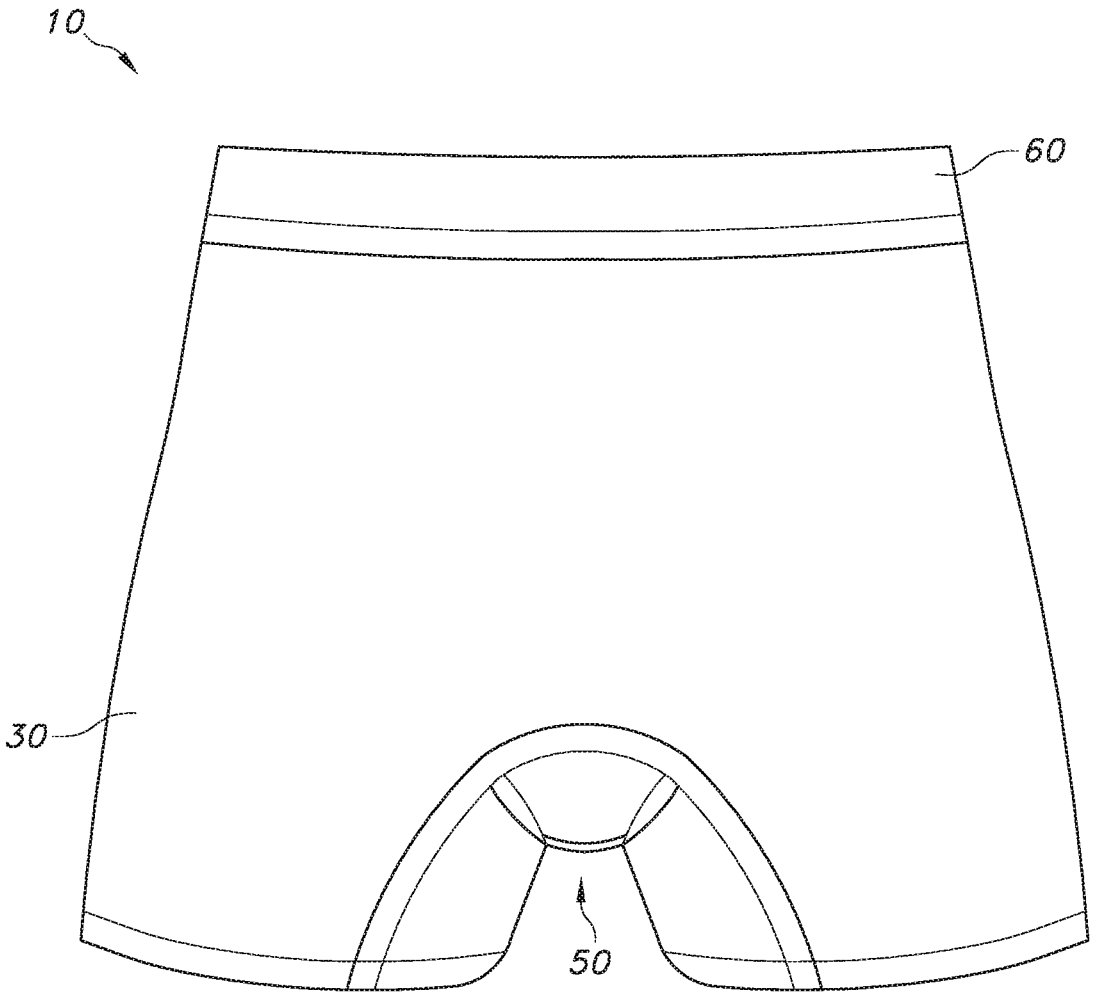
FIG. 6 shows the interior plan view of the rear portion of the underwear of FIG. 4 or FIG. 5.

According to a representative embodiment of the inventive subject matter, the strip 50 is a unitary piece of fabric sewn to the interior surface of the front portion 20, generally symmetric about a vertical midline 22 of the front portion. The strip of fabric 50 has two arms 42*a*, 42*b*. When laid flat, the strip 50 has a generally curved shape extending from the top of the front portion 20 to the mid-bottom area of the front portion 20 where it connects to the mid-bottom area of the rear portion 30. As shown in FIGS. 4-5, the strip of fabric 50 has two ends 26*a*, 26*b* at the top of the two arms 42*a*, 42*b*, connecting to the waist band portion 60. The strip of fabric 50 also has an integral bottom section 46 where the two arms 42*a*, 42*b* extend downwardly and merge together at the bottom region 56 of the genitalia receiving compartment 40, being configured to loop around the bottom of scrotum of the intended wearer. In some embodiments, as illustrated in FIG. 4, the two top ends 26*a*, 26*b* are separate on the waist band portion 60 so that the strip of fabric 50 forms an elongated U-shape opening 48 for receiving the genitalia when the underwear is laid flat. In other embodiments, as illustrated in FIG. 5 the two top ends 26*a*, 26*b* are merged on the waist band portion 60 so that the strip of fabric 50 forms an almond-shaped opening 48 for receiving the genitalia when the underwear is laid flat. In some possible embodiments, the top ends 26*a*, 26*b* and the waist band portion 60 may be part of a unitary seamless knit or woven structure. In general, it is advantageous for the strip 50 connecting to the waist band portion 60 so as to create a large enclosed volume of the genitalia receiving compartment 40, for improved ventilation and better support.

According to some embodiments, the strip of fabric 50 is wider in the bottom section 46 than the top ends 26*a*, 26*b*. As illustrated in FIGS. 4-5, the width of the strip Ws, which is the distance between the opening edge 44 and nearest peripheral seam 24, becomes progressively narrower from the bottom section 46 to the top ends 26*a*, 26*b*. In one example, the width of the strip 50 is about 1±0.3 inch at the top ends 26*a*, 26*b* of the two arms 42*a*, 42*b*, and about 2±0.5 inches at the bottom section 46 of the strip. In certain embodiments, the width of the opening Wo, is sufficiently narrow so as to prevent a genitalia of the wearer from inadvertently escaping the genitalia receiving compartment 40. In one exemplary embodiment, the width of the opening 48 is between about 0.5±0.2 inch and about 1±0.4 inch when the strip of fabric 50 is in natural unstretched condition. The foregoing metrics are for purposes of illustration and not limitation.

Since the orientation of the strip 50 is substantially parallel to the front portion 20, the space of the genitalia receiving compartment 40 that is behind the strip 50 is effectively covered. A wider strip may effectively enclose a larger volume of the genitalia receiving compartment. Thus the enclosed volume gradually increases from the top to the bottom region of the genitalia receiving compartment 40, facilitating accommodation of the male genitalia and reducing chaffing or perspiration accumulation in the inner upper thigh region of the wearer. In addition, the parallel arrangement of the strip 50 with respect to the front portion 20 also makes the two arms 42*a*, 42*b* more resistant to lateral stretching. As a result, the width of the opening 48 will remain relatively narrow despite lateral stretching of the underwear, thus may prevent wearer's genitalia from inadvertently escaping the genitalia receiving compartment 40.

In some embodiments, the genitalia receiving compartment 40 has an outwardly bulging space at the bottom section 46 of the strip of fabric 50. Various methods may be used to form the outwardly bulging space. In one example, the outwardly bulging space is formed by a midline seam 22, which bisects the front portion 20 of the torso encircling member 10 along the midline of the front portion 20, extending from the waist band portion 60 to the bottom region 56 of the genitalia receiving compartment 40. The outwardly bulging space provides an extended space for the apical part of the phallus of the wearer in its natural resting position.

According to some embodiments of the inventive subject matter, the strip of fabric 50 has no seam binding at the edge 44 of the opening 48 for receiving the genitalia. Since the edge 44 of the opening 48 may frequently contact the genitalia, the absence of binding stitches in the edge 44 of the opening 48 will reduce the likelihood of skin irritation and chaffing. Different methods may be used to create the curved binder-less edge of the strip. In certain embodiments, the absence of seam binding at the U-shaped or almond shaped opening edge may be achieved by a skipped-needle knitting technique which selectively skip or pull certain stitches. In alternative embodiments, the curved strip 50 without binder edge may be without a skipped needle technique. For example, it may be created by cutting a plurality of notches on the edge 44, and then sewing the strip 50 to the front portion 20.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

All patent and non-patent literature cited herein is hereby incorporated by references in its entirety for all purposes.

As used herein, "and/or" means "and" or "or", as well as "and" and "or." Moreover, any and all patent and non-patent literature cited herein is hereby incorporated by references in its entirety for all purposes.

The principles described above in connection with any particular example can be combined with the principles described in connection with any one or more of the other examples. Accordingly, this detailed description shall not be construed in a limiting sense, and following a review of this disclosure, those of ordinary skill in the art will appreciate the wide variety of systems that can be devised using the various concepts described herein. Moreover, those of ordinary skill in the art will appreciate that the exemplary embodiments disclosed herein can be adapted to various configurations without departing from the disclosed principles.

The previous description of the disclosed embodiments is provided to enable any person skilled in the art to make or use the disclosed innovations. Various modifications to those embodiments will be readily apparent to those skilled in the art, and the generic principles defined herein may be applied to other embodiments without departing from the spirit or scope of this disclosure. Thus, the claimed inventions are not intended to be limited to the embodiments shown herein, but are to be accorded the full scope consistent with the language of the claims, wherein reference to an element in the singular, such as by use of the article "a" or "an" is not intended to mean "one and only one" unless specifically so stated, but rather "one or more".

All structural and functional equivalents to the elements of the various embodiments described throughout the disclosure that are known or later come to be known to those of ordinary skill in the art are intended to be encompassed by the features described and claimed herein. Moreover, nothing disclosed herein is intended to be dedicated to the public regardless of whether such disclosure is explicitly recited in the claims. No claim element is to be construed as "a means plus function" claim under US patent law, unless the element is expressly recited using the phrase "means for" or "step for".

The invention claimed is:

1. An underwear for a male wearer, comprising:

a torso encircling member including a front portion and a rear portion;

an elastic waist band portion disposed at a top of the torso encircling member; and a genitalia-receiving compartment defined by a midsection of the front portion and a strip of fabric associated with an inside of the front portion;

wherein the strip of fabric connects to the elastic waist band portion, and has a bottom section extending downwardly to loop around the bottom of the intended wearer's scrotum in a worn condition, and a first edge that is coupled to the front portion to define a periphery of the genitalia-receiving compartment on the front portion, and is oriented substantially flat and parallel to the front portion in an unworn flattened condition, and wherein the strip has a free edge not coupled to the front portion and defining an opening perimeter of the genitalia-receiving compartment, the strip thereby configured to extend from the periphery of the genitalia-receiving compartment and loop around and cup the bottom of the intended wearer's scrotum in the worn condition;

wherein the width of the strip of fabric, as defined between the first edge and the free edge, narrows progressively from the bottom of the loop to the waist band portion.

2. The underwear of claim 1, wherein stitching is used to couple and orient the coupled edge of the strip of fabric on the front portion.

3. The underwear of claim 1, wherein the strip of fabric has two top ends connecting to the waist band portion.

4. The underwear of claim 3, wherein the two top ends are separated from one another on the waist band portion, with the strip of fabric forming an elongated U-shape opening for receiving the genitalia of the intended wearer, with the bottom of the U-Shape configured to cup the bottom of the intended wearer's scrotum.

5. The underwear of claim 3, wherein the two top ends are merged on the waist band portion with the strip of fabric forms an almond-shaped opening for receiving the genitalia of the intended wearer in the worn condition.

6. The underwear of claim 1, wherein the free edge is finished with skipped-needle knitting.

7. The underwear of claim 1, wherein the genitalia-receiving compartment has an outwardly bulging space at a bottom section of the strip of fabric.

8. The underwear of claim 1, wherein the strip of fabric comprises a material different from the front portion.

9. The underwear of claim 1, wherein the strip of fabric comprises elastic mesh material.

10. The underwear of claim 1, wherein the front portion and the rear portion comprise elastic materials.

11. The underwear of claim 1, wherein the free edge of the strip of fabric is free of seam binding.

12. The underwear of claim 1, wherein the entire free edge of the strip of fabric is oriented flat and parallel to the front portion in an unworn flattened condition.

13. A method for making a male underwear, comprising:

providing a torso encircling member including a front portion and a rear portion;

disposing an elastic waist band portion at the top of the torso encircling member; and forming a genitalia receiving compartment by coupling a strip of fabric to a midsection of the inside of the front portion; wherein the strip is oriented generally parallel to the front portion, wherein the strip of fabric connects to the elastic waist band portion, and has a bottom section extending downwardly to loop around the bottom of the intended wearer's scrotum in a worn condition, and a first edge that is coupled to the front portion to define a periphery of the genitalia-receiving compartment on the front portion, and is oriented substantially flat and parallel to the front portion in an unworn flattened condition, and wherein the strip has a free edge not coupled to the front portion and defining an opening perimeter of the genitalia-receiving compartment, the strip thereby configured to extend from the periphery of the genitalia-receiving compartment and loop around and cup the bottom of the intended wearer's scrotum in the worn condition;

wherein the width of the strip of fabric, as defined between the first edge and the free edge, narrows progressively from the bottom of the loop to the waist band portion.

14. The method of claim 13, wherein stitching is used to couple and orient the strip of fabric on the front portion.

15. The method of claim 13, wherein the strip of fabric has two top ends connecting to the waist band portion.

16. The method of claim 15, wherein the two top ends are separated from one another on the waist band portion so that the strip of fabric forms an elongated U-shape opening for receiving the genitalia of the intended wearer.

17. The method of claim 15, wherein the two top ends are merged on the waist band portion so that the strip of fabric forms an almond-shaped opening for receiving the genitalia of the intended wearer.

18. The method of claim 13, wherein the strip of fabric forms an opening for receiving the genitalia of the intended wearer and there is no seam binding at an edge of the strip that is coupled to the front portion.

19. The method of claim 13, wherein the genitalia receiving compartment has an outwardly bulging space at a bottom section of the strip of fabric.

* * * * *